US005443192A

United States Patent [19]

Hodges et al.

[11] Patent Number: 5,443,192

[45] Date of Patent: Aug. 22, 1995

[54] BELT-MOUNTED DETACHABLE HOLSTER FOR HOLDING A CHEMICAL DETERRENT CANISTER

[75] Inventors: James L. Hodges, Friendsville, Tex.; John H. McLaughlin, Glidden, Iowa

[73] Assignee: McLaughlin International, Inc., Scranton, Iowa

[21] Appl. No.: 241,141

[22] Filed: May 10, 1994

[51] Int. Cl.[6] ..... A45F 5/00

[52] U.S. Cl. ..... 224/253; 224/148; 224/236; 224/240; 224/250; 224/914

[58] Field of Search ..... 224/148, 215, 217, 218, 224/236, 239, 240, 242, 247, 250, 251, 252, 253, 269, 904, 914, 911, 216, 195, 163, 268

[56] References Cited

U.S. PATENT DOCUMENTS

| | | | |
|---|---|---|---|
| 1,207,154 | 12/1916 | Fox | 224/268 |
| 2,699,192 | 1/1955 | Poutinen | 150/35 |
| 2,812,606 | 11/1957 | Painter | 40/130 |
| 2,940,641 | 6/1960 | Norrish et al. | 222/183 |
| 3,286,751 | 11/1966 | Dishart | 150/35 |
| 3,445,046 | 5/1969 | Wilson | 224/148 |
| 3,484,023 | 12/1969 | Meshberg | 222/402.11 |
| 3,637,120 | 1/1972 | Clay | 224/5 A |
| 3,664,560 | 5/1972 | Perkins | 224/901 |
| 4,220,263 | 9/1980 | Caruso | 222/183 |
| 4,479,596 | 10/1984 | Swanson | 224/236 |
| 4,588,116 | 5/1986 | Litman | 224/914 |
| 5,287,995 | 2/1994 | Redman et al. | 224/242 |
| 5,305,874 | 4/1994 | McLaughlin | 206/37 |

FOREIGN PATENT DOCUMENTS

| | | | |
|---|---|---|---|
| 0002791 | of 1910 | United Kingdom | 224/268 |

OTHER PUBLICATIONS

Mixson Leathercraft, Inc. Catalog 576, Hialeah, Fla. 33014.

Bucheimer Co. Catalog, Frederick, Md. 21701, Jan., 1971.

Bucheimer Clark Catalog, Stanford/Valencia, Calif. 91355 Jan., 1973.

Ray O'Herron Co. Catalog, Danville, Ill. 61832, 1974.

Bucheimer Police Equipment Catalog, Frederick, Md. 21701, Jan., 1974.

Safariland 1975 Catalog.

Tex Shoemaker & Sons, Inc. Catalog, San Dimas, Calif. 91733.

Advertisement–Chemical Lance, P.O. Box 14935, Orlando, Fl. 32807.

Advertisement–Chemical Lance, P.O. Box 20393, Orlando, Fl. 32803.

"Chemical Lance" Montgomery Ward Advertisement, Sentinel Star Orlando, Fla., Nov. 10, 1974.

George Stuart "Chemical Lance" Advertisement, Metro News, Nov. 28, 1974.

*Primary Examiner*—J. Casimer Jacyna
*Assistant Examiner*—Timothy L. Maust
*Attorney, Agent, or Firm*—Henderson & Sturm

[57] ABSTRACT

A holster apparatus for use in combination with a self-protection chemical dispenser having a cylindrical body equipped with a spray nozzle and an actuator button. The holster includes a casing having a body portion for receiving the dispenser. The casing also includes a first retainer at one end thereof which can be a flap and a second retainer at the other end thereof for selectively holding the dispenser in the casing in the position so that the dispenser can be actuated by the actuator button to cause protective chemicals to be sprayed from the spray nozzle while the dispenser is in the casing. Separate belt connectors adapted to be attached to a user's belt and an attaching structure is provided for operably connecting or disconnecting the casing to the belt connector whereby the casing with the dispenser therein can be quickly and easily accessed for use or stored away for immediate re-access. A structure is provided for allowing the device to quickly convert from left hand to right hand use on an officer's belt. Structure is provided for making it difficult to open the flap on the casing and another structure is provided for making it difficult for an unauthorized person to remove the dispenser from the casing.

14 Claims, 3 Drawing Sheets

BELT-MOUNTED DETACHABLE HOLSTER FOR HOLDING A CHEMICAL DETERRENT CANISTER

TECHNICAL FIELD

The present invention relates generally to a holster apparatus for use in combination with a self-protection chemical dispenser of a type having a cylindrical body equipped with a spray nozzle and an actuator button, and more particularly to such a holster apparatus for use by law enforcement officers or the like.

BACKGROUND ART

Law enforcement officers use self-protection chemical dispensers for dispensing mace or the like to subdue criminals so that when a person resists arrest, the officer can subdue this person quickly without resorting to deadly force such as by using a handgun or the like. Officers have carried a holster with a self-protection chemical dispenser therein for years. Those persons intent on resisting arrest are aware of these holsters and have been known to try to take the canister away from the arresting officer by unsnapping the top of the holster and moving the dispenser from its holster. Consequently, there is a need for a new holster apparatus to discourage and prevent this from happening.

DISCLOSURE OF THE INVENTION

The present invention relates to a holster apparatus for use in combination with a self-protection chemical dispenser having a cylindrical body equipped with a spray nozzle and an actuator button. The holster includes a casing having a body portion for receiving the dispenser. The casing also includes a first retainer at one end thereof which can be a flap and a second retainer at the other end thereof for selectively holding the dispenser in the casing in the position so that the dispenser can be actuated by the actuator button to cause protective chemicals to be sprayed from the spray nozzle while the dispenser is in the casing. Separate belt connectors adapted to be attached to a user's belt and an attaching structure is provided for operably connecting or disconnecting the casing to the belt connector whereby the casing with the dispenser therein can be quickly and easily accessed for use or stored away for immediate re-access. A structure is provided for allowing the device to quickly convert from left hand to right hand use on an officer's belt. Structure is provided for making it difficult to open the flap on the casing and another structure is provided for making it difficult for an unauthorized person to remove the dispenser from the casing.

An object of the present invention is to provide an improved holster apparatus for holding a self-protection chemical dispenser.

Another object of the invention is to provide a holster apparatus which is easily convertible from left hand to right hand use.

A further object of the invention is to provide a structure for allowing the casing and canister to be removed as a unit from the belt connector and easily re-attached to remain quickly accessible when needed.

A still further object of the invention is to provide a decoy-type of snap connector on the flap so that an unauthorized person cannot easily open the flap but the user can quickly open the snap because of knowing where to pull on it.

Another object of the present invention is to provide a holster apparatus which allows the casing and canister to be stored upright or upside down as desired by the officer using it.

Other objects, advantages, and novel features of the present invention will become apparent from the following detailed description of the invention when considered in conjunction with the accompanying drawings.

BEST MODE FOR CARRYING OUT THE INVENTION

Figure 1:
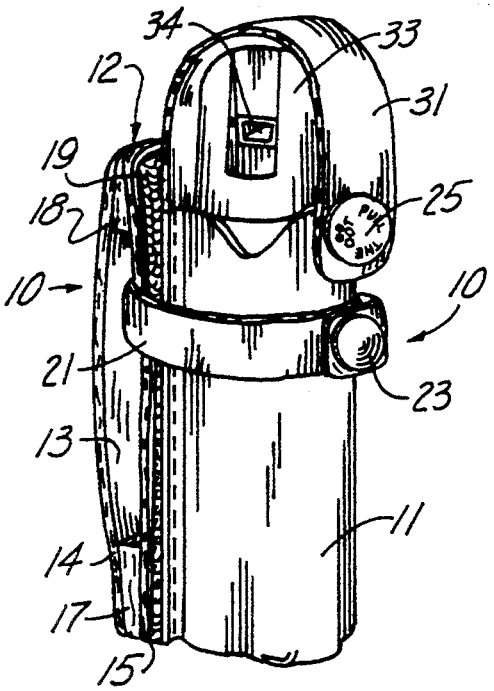
FIG. 1 is a perspective view of a preferred embodiment of the present invention shown for attachment to the left side of an officer's belt.
Figure 3:
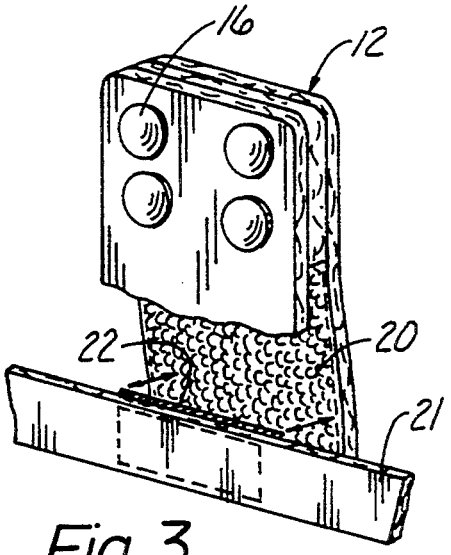
FIG. 3 is an enlarged cut-away view showing how a safety strap can be attached to the belt connector or turned around if desired.
Figure 2:
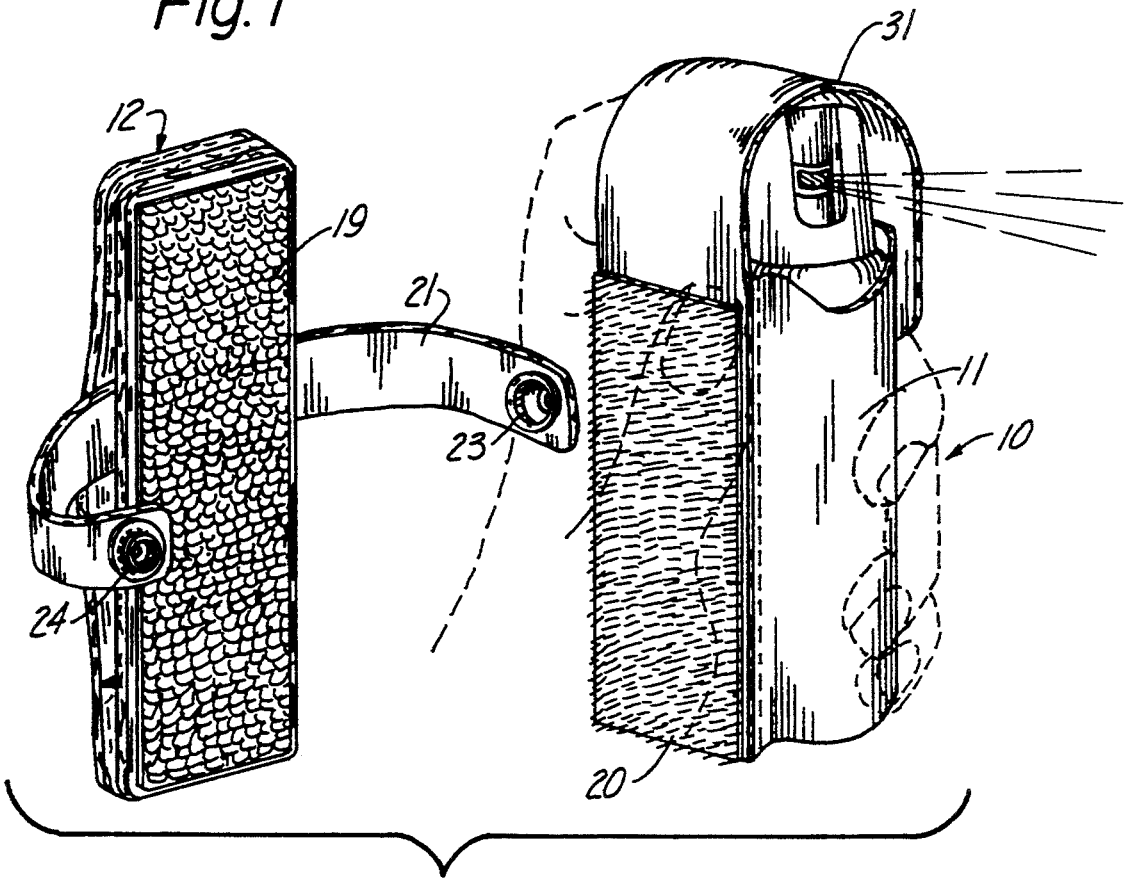
FIG. 2 is an exploded perspective view showing how the canister and its casing can be easily removed from the belt connecter and utilized with the left hand.

Referring now to the drawings wherein like reference numerals designate identical or corresponding parts throughout the several views, FIG. 1 shows a holster apparatus (10) constructed in accordance with the present invention and having a casing (11) connected to a belt connector (12). The belt connector (12) has a slot (13) formed between two leather members (14) and (15) which are riveted together by rivets (16) and through spacers (17) and (18). The outer face of the belt connector (12) is covered with loops (19) of a hook-and-loop fastener for connection to hooks (20) of the hook-and-loop fastener which are sewn to the casing (11).

The belt connector (12) also has hook portions (20) of a hook-and-loop fastener for attachment of a flexible strap (21) having hook portion (22) for connection to loop portion (20) of the belt connector (12). It is to be understood of course that the hook portion and loop portion of the hook-and-loop fasteners (19) and (20) and (20) and (22) can be reversed if desired.

Figure 8:
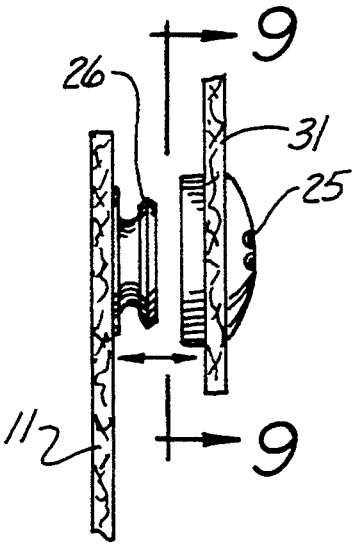
FIG. 8 is a side elevational and cross sectional view of the snap structure shown in FIG. 7.

The flexible strap (21) extends around the casing (11) as shown in FIG. 1 and has an upper snap (23) on one end thereof and a lower snap (24) on the other end thereof. The casing (11) has a flap (31) thereon with one end of the flap (31) having a "pull-the-dot snap" portion (25) thereof which attaches to a complementary snap portion (26) attached to casing (11) as is clearly shown in FIG. 8. The snap (25) of FIG. 8 is of a type which is commercially available which has two-dot portions (27) which permit the snap (25) to be easily removed from snap portion (26) when the flap (31) is pulled from the dotted side at (27) but substantially prevents the snap (25) from being removed from snap portion (26) when the other side (29) is attempted to be pulled up because of flange (28) which is disposed below the portion (29) of the snap (25). An ordinary snap would not have the flange (28) thereon which catches on the underside of the lip of (26) and prevents it from being opened at that point.

Figure 4:
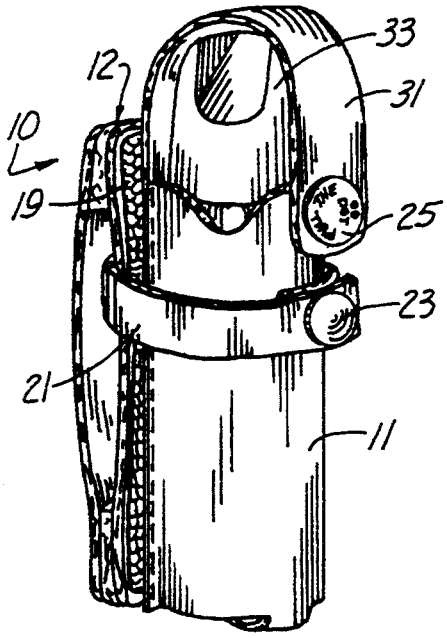
FIG. 4 is a perspective of the apparatus shown in FIG. 1 but shown in a position to be used on the right side of a user's belt.

A canister (32) containing a self-protection chemical under pressure such as mace or the like has a cap (33) which can swivel 360° about the longitudinal axis of the cylindrical canister (32). A cap (33) has a nozzle (34) therein so that when the top portion (35) of the cap (33) is pushed, the self-protection chemical will spray out in a stream through nozzle (34). The cap (33) would be turned in the position shown in FIG. 1 when the holster apparatus (10) is to be utilized on the left side of a person while the cap (33) would be turned in the position shown in FIG. 4 when the holster apparatus (10) is to be used from the right side.

The holster (10) is a three-part, interchangeable part unit, including the belt connector (12), the canister (11) and the strap (21). Consequently, this enables the purchaser to buy replacement parts for those damaged or worn out, instead of replacing the entire unit. The holster (10) is fully adjustable to individual comfort, which also affords the user maximum safety. The holster (10) is also fully adjustable to the left or right-hand use by simply turning the flexible strap (21) upside down.

Some unique innovations of use can be that the officer can carry the holster behind other gear, such as a radio, cuff case, etc., and yet be able to adjust it so that it is still safely accessible. Also, the cylinder in its case can be turned upside down on the hook-and-loop fastener pad, because some officers merely feel that is more comfortable and easier to operate.

Figure 5:
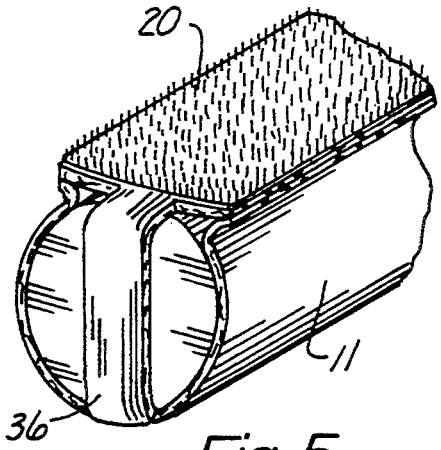
FIG. 5 is a bottom view of the casing.
Figure 6:
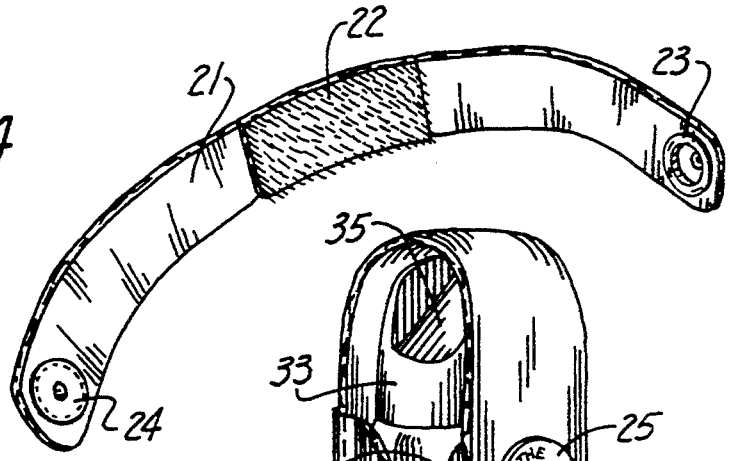
FIG. 6 is a perspective view of the three main parts of the holster.
Figure 6:
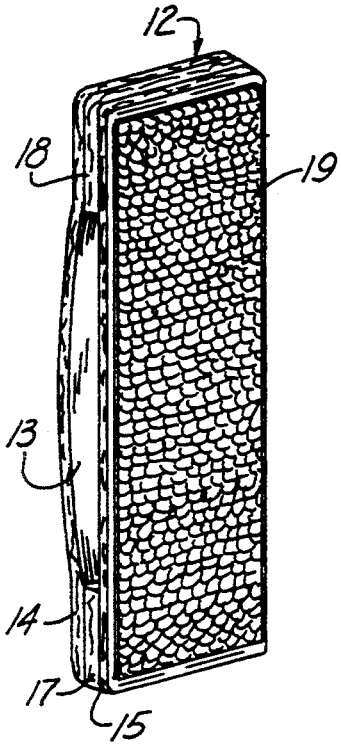
Figure 6:
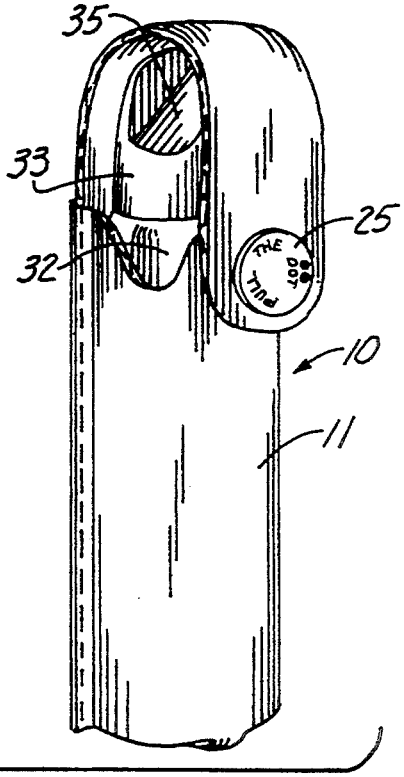
Figure 7:
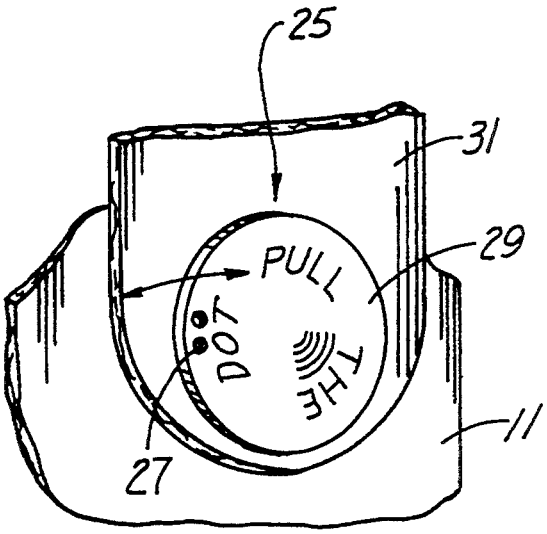
FIG. 7 is an enlarged perspective view of a snap structure for discouraging unauthorized use.
Figure 9:
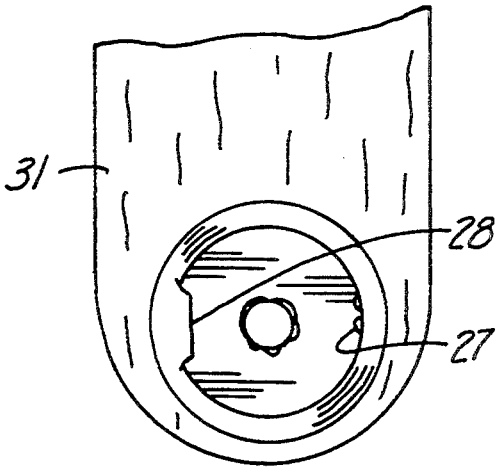
FIG. 9 is a view taken along line 9—9 of FIG. 8 and showing structure which allows the top snap to be removed from one side but prevents it from being removed from the other side of the snap.

The holster (10) has unique safety features. The "pull-the dot and snap" is a decoy to the would-be attacker. It makes the holster flap (31) hard, if not impossible, to open. Consequently, the holster may not be utilized in a conventional manner. Also, the canister cannot be drawn from the casing (11), even if the flap (31) with its "pull-the-dot and snap" feature is defeated, because the canister (32) form fits into the casing (11) so that it is extremely difficult to remove and almost requires two hands or perhaps a screwdriver or the like pushing up from the bottom thereof past lower retainer flap (36) shown in FIG. 5. This allows the officer a little extra time to react to a violet grab for the officer's canister (32). The officer is then able to execute reverse wrist techniques to defend the attack.

The holster (10) allows quick and immediate dispatch of the canister (32) from the duty belt (not shown) but which extends through opening (13), so that the officer, if grabbed or attacked in any manner, can immediately break the attacker away, regardless of the physical condition or size of the attacker. Should the officer draw the canister (32) from the duty belt and then realize he has to resort to deadly force, he simply slaps the canister back to the loops (19) from where it was drawn, without taking his eyes off of the attacker. The heavy-duty hook-and-loop fastener (19) and (20) holds the casing (11) and canister (32) securely until the incident is over. This also allows the officer the versatility to go from an open hand situation to a deadly force situation, and back and forth with great dispatch. Additionally, the holster is streamline both horizontally and vertically to conserve valuable space on the duty belt, which can be critical.

Obviously, many modifications and variations of the present invention are possible in light of the above teachings. It is therefore to be understood that, within the scope of the appended claims, the invention may be practiced otherwise than as specifically described.

We claim:

1. A holster apparatus for use in combination with a self-protection chemical dispenser having a cylindrical body equipped with a spray nozzle and an actuator button, wherein the holster apparatus comprises:

a casing including a body portion for receiving said dispenser, said casing also including a first retainer at one end thereof and a second retainer at the other end thereof for selectively holding said dispenser in said casing in a position so that the dispenser can be actuated by the actuator button to cause protective chemicals to be sprayed from said spray nozzle while said dispenser is in said casing;

a belt connector adapted to be attached to a user's belt; and attachment means for operably connecting or disconnecting said casing to said belt connector whereby said casing with said dispenser therein can be quickly and easily accessed for use or stored away ready for immediate access, said attachment means Comprises hook and 10op fasteners on said belt connector and on said casing.

2. The apparatus of claim 1 including a flexible strap disposed around said belt connector and said casing, said flexible strap including connectable fasteners at each end thereof for selectively and supplementally holding said casing onto said belt connector in addition to hook and loop fasteners which constitute a primary way of attaching the casing to the belt connector.

3. The apparatus of claim 2 wherein one end of said flexible strap overlaps the other end thereof when the ends of said flexible strap are fastened together.

4. The apparatus of claim 3 wherein the overlapping end which is on top points in a forward direction when said holster apparatus is on a person's belt whereby it can easily be snapped open by the person's hand closest thereto.

5. The apparatus of claim 4 including means for permitting said flexible strap to be reversed so it can be used on either the right or left side of a user's belt and still have the top end of said overlapping ends pointing forwardly.

6. The apparatus of claim 5 including a slot in said belt connector for receiving both a belt and said flexible strap therethrough.

7. The apparatus of claim 7 including hook and loop fasteners on said flexible strap and on the outside portion of said slot and on said belt connector for releasably holding said flexible strap in a desired position with respect to said belt connector.

8. The apparatus of claim 7 wherein said first retainer comprises a flap having a first fastener on one end thereof for operative engagement with a second fastener on said casing for selectively connecting or disconnecting said one end of the flap to the casing.

9. The apparatus of claim 8 wherein said first and second fasteners are complementary snaps.

10. The apparatus of claim 9 including means associated with said first and second snaps for preventing said snaps from being separated when a person tries to pull them apart when pulling on the topmost one thereof from one side thereof and permitting said snaps to be easily pulled apart when pulling on the topmost one thereof from the other side thereof.

11. The apparatus of claim 10 wherein said other side of said snaps is the front side thereof when said holster apparatus is being worn on a belt whereby someone trying to pull the snaps open will be unsuccessful because such person will normally be facing the wearer of the holster and will consequently normally be pulling on the back side of the topmost snap, which is the one side from which the snaps cannot be easily opened.

12. The apparatus of claim 11 wherein said other side of said topmost snap is immediately above the overlapping end of the flexible strap which is on top whereby a user can quickly and easily open the snaps on the flap and the fasteners on the ends of the flexible strap with one quick motion of one hand.

13. The apparatus of claim 12 whereby the size of the dispenser is slightly larger than the size of the opening in the casing whereby the dispenser is form fitted into the casing making it difficult to quickly remove by someone trying to take it from the person wearing the holster apparatus.

14. The apparatus of claim 13 wherein a cap on the dispenser includes means for permitting it to be rotated about an axis whereby the nozzle can be adjusted to face forwardly regardless of whether it is disposed on the left or the right side of the user.

* * * * *